US010358896B2

(12) United States Patent
Romer et al.

(10) Patent No.: US 10,358,896 B2
(45) Date of Patent: Jul. 23, 2019

(54) APPARATUS FOR WIRELINE PICKUP WEIGHT MITIGATION AND METHODS THEREFOR

(71) Applicants: Michael C. Romer, The Woodlands, TX (US); Randy C. Tolman, Spring, TX (US)

(72) Inventors: Michael C. Romer, The Woodlands, TX (US); Randy C. Tolman, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 369 days.

(21) Appl. No.: 15/208,696

(22) Filed: Jul. 13, 2016

(65) Prior Publication Data

US 2017/0096868 A1 Apr. 6, 2017

Related U.S. Application Data

(60) Provisional application No. 62/237,109, filed on Oct. 5, 2015.

(51) Int. Cl.
*E21B 43/08* (2006.01)
*E21B 23/03* (2006.01)

(52) U.S. Cl.
CPC ..... *E21B 43/08* (2013.01); *E21B 23/03* (2013.01)

(58) Field of Classification Search
CPC ..... E21B 23/03; E21B 43/08
See application file for complete search history.

(56) References Cited

U.S. PATENT DOCUMENTS

2005/0284637 A1* 12/2005 Stegent ..... C09K 8/5758 166/308.1
2006/0011345 A1* 1/2006 Delaloye ..... E21B 37/06 166/304
2016/0194939 A1* 7/2016 Lastra ..... E21B 41/00 166/383

* cited by examiner

*Primary Examiner* — Kristyn A Hall
(74) *Attorney, Agent, or Firm* — ExxonMobil Upstream Research Company—Law Department

(57) ABSTRACT

Apparatus and methods for reducing the force required to pull a device from a tubular, the apparatus including a tubular sealing device for mating with a downhole tubular component, the tubular sealing device having an axial length and a longitudinal bore therethrough; and an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device.

25 Claims, 5 Drawing Sheets

APPARATUS FOR WIRELINE PICKUP WEIGHT MITIGATION AND METHODS THEREFOR

CROSS REFERENCE TO RELATED APPLICATION

This application claims the benefit of U.S. Provisional Application No. 62/237,109, filed Oct. 5, 2015, entitled "Apparatus For Wireline Pickup Weight Mitigation And Methods Therefor," the disclosure of which is incorporated by reference herein.

FIELD

The present disclosure relates to systems and methods for reducing the force required to pull a device from a tubular.

BACKGROUND

When first completed, many gas wells have sufficient reservoir pressure to flow formation fluids to the surface along with the produced gas. As gas production continues, the reservoir pressure declines, and as pressure declines, the velocity of the fluid in the well tubing decreases. Eventually, the gas velocity up the production tubing is no longer sufficient to lift liquid droplets to the surface. Liquids may then accumulate in the tubing, creating additional pressure drop, slowing gas velocity, and raising pressure in the reservoir surrounding the well perforations and inside the casing. As the bottom well pressure approaches reservoir shut-in pressure, gas flow may stop and liquids can accumulate at the bottom of the tubing.

At different stages in the life of a gas well, various means can be employed to move accumulated liquids to the surface. These may include foaming agents or surfactants, velocity tubing, plunger lift, and downhole pumps. The proper application of pumps can lower the abandonment pressure of wells, increasing reserves captured per well, and reduce the number of wells required to economically deplete an asset.

Micro positive displacement pumps and solid state pumps are under consideration for field applications. Deployment of such pumps may be by commercially available wireline cable capable of transmitting about 2,500 watts or more of electricity to an AC or DC motor, or solid state device, powering the unit.

The break-strength of commercially available wireline can be on the order of about 20,000 lb for a 7/16" cable. Additionally, manufacturers do not recommend exceeding 60% of the break-strength for a given cable. With a pump seated at 10,000 ft, with 9.0 ppg produced water, and assuming a tool having an outside diameter of about 2.5", the total pickup weight of the entire assembly can exceed 22,000 lb, which is well in excess of the 60% working load of a 7/16" cable. As may be appreciated, such loads could make the seating of such pumps at those depths prohibited.

Therefore, what are needed are systems and methods for reducing the force required to pull a device from a tubular.

SUMMARY

In one aspect, disclosed herein is an apparatus for reducing the force required to pull a device from a tubular. The apparatus includes a tubular sealing device for mating with a downhole tubular component, the tubular sealing device having an axial length and a longitudinal bore therethrough; and an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device.

In some embodiments, the elongated rod includes an axial flow passage extending therethrough.

In some embodiments, the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the apparatus is integral to the tubing string.

In some embodiments, the first end of the elongated rod includes an extension for applying a jarring force to the tubular sealing device to assist in the removal thereof.

In some embodiments, the first end of the elongated rod is structured and arranged for placing it in fluid communication with a pump upstream or downstream of the tubular sealing device.

In another aspect, disclosed herein is a system for removing fluids from a well. The system includes a pump having an inlet end and a discharge end, the pump placed within a tubular; a driver operatively connected to the pump for driving the pump; and an apparatus for reducing the force required to pull the pump from the tubular, the apparatus positioned upstream of the pump and comprising a tubular sealing device for mating with a downhole tubular component, the tubular sealing device having an axial length and an longitudinal bore therethrough; and an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device, wherein the elongated rod includes an axial flow passage extending therethrough, the axial flow passage in fluid communication with the pump.

In some embodiments, the system also includes a well screen or filter in fluid communication with the inlet end of the pump, the well screen or filter having an inlet end and an outlet end; and a velocity fuse or standing valve positioned between the outlet end of the well screen or filter and the first end of the elongated rod.

In some embodiments, the velocity fuse is structured and arranged to back-flush the well screen or filter and maintain a column of fluid within the tubular in response to an increase in pressure drop across the velocity fuse.

In some embodiments, the velocity fuse is normally open and comprises a spring-loaded piston responsive to changes in pressure drop across the velocity fuse.

In some embodiments, the tubular sealing device of the apparatus is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the apparatus is integral to the tubing string.

In some embodiments, the first end of the elongated rod includes an extension for applying a jarring force to the tubular sealing device to assist in the removal thereof.

In yet another aspect, disclosed herein is a method for reducing the force required to pull a device from a tubular. The method includes connecting an apparatus positioned within a tubular to a retrieval mechanism, the apparatus including a tubular sealing device having an axial length and a longitudinal bore therethrough; and an elongated rod slidably positionable within the longitudinal bore of the tubular sealing device, the elongated rod structured and arranged to provide i) a hydraulic seal when the elongated rod is in a first position within the longitudinal bore, and ii) at least one external flow port for pressure equalization upstream and downstream of the tubular sealing device when the elongated rod is placed in a second position within the longitudinal bore; applying a force to the elongated rod of the apparatus; pulling the elongated rod through the tubular sealing device; and equalizing the pressure upstream and downstream of the tubular sealing device.

In some embodiments, the method also includes applying a jarring force to the upstream side of the tubing sealing assembly to assist in the removal thereof.

In some embodiments, the method also includes back-flushing an upstream well screen or filter installed within the tubular.

In some embodiments, the step of back-flushing an upstream well screen or filter includes providing a differential pressure across a velocity fuse, the velocity fuse positioned downstream of the well screen or filter, to create a high-velocity stream of fluid to back-flush the upstream well screen or filter; removing debris from the upstream well screen or filter; closing the velocity fuse using the high-velocity fluid stream; and setting the elongated rod to the first position to establish the hydraulic seal.

In some embodiments, the velocity fuse is structured and arranged to maintain a column of fluid within the tubular in response to an increase in pressure drop across the velocity fuse.

In some embodiments, the velocity fuse comprises a spring-loaded piston responsive to changes in pressure drop across the velocity fuse.

In some embodiments, the elongated rod includes an axial flow passage extending therethrough.

In some embodiments, the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the apparatus is integral to the tubing string.

In still yet another aspect, disclosed herein is a wellbore. The wellbore includes a borehole extending into an earth formation; a tubular extending into the borehole; and an apparatus for reducing the force required to pull a device from the tubular, the apparatus comprising i) a tubular sealing device for mating with a downhole tubular component, the tubular sealing device having an axial length and a longitudinal bore therethrough; and ii) an elongated rod slidably positionable within the longitudinal bore of the tubular sealing device, the elongated rod having a first end, a second end, and an outer surface, the outer surface structured and arranged to provide 1) a hydraulic seal when the elongated rod is in a first position within the longitudinal bore of the tubular sealing device, and 2) at least one external flow port for pressure equalization upstream and downstream of the tubular sealing device when the elongated rod is placed in a second position within the longitudinal bore of the tubular sealing device.

In a further aspect, disclosed herein is a method of forming a completion system within a wellbore. The method includes installing a tubular within a borehole, installing a pump within the tubular, the pump having an inlet end and a discharge end and a driver operatively connected to the pump for driving the pump; and installing an apparatus for reducing the force required to pull the pump from the tubular, the apparatus positioned upstream of the pump and comprising a tubular sealing device for mating with a downhole tubular component, the tubular sealing device having an axial length and an longitudinal bore therethrough; and an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device, wherein the elongated rod includes an axial flow passage extending therethrough, the axial flow passage in fluid communication with the pump.

In some embodiments, the method also includes installing one or more packers to isolate one or more production zones within the wellbore.

In a still further aspect, disclosed herein is a method of producing hydrocarbons from a subterranean formation. The method includes providing a borehole extending into a hydrocarbon-bearing zone of the formation; installing a tubular into the borehole; installing an apparatus for reducing the force required to pull a device from the tubular, the apparatus comprising i) a tubular sealing device for mating with a downhole tubular component, the tubular sealing device having an axial length and a longitudinal bore therethrough; and ii) an elongated rod slidably positionable within the longitudinal bore of the tubular sealing device, the elongated rod having a first end, a second end, and an outer surface, the outer surface structured and arranged to provide 1) a hydraulic seal when the elongated rod is in a first position within the longitudinal bore of the tubular sealing device, and 2) at least one external flow port for pressure equalization upstream and downstream of the tubular sealing device when the elongated rod is placed in a second position within the longitudinal bore of the tubular sealing device; and producing a fluid comprising hydrocarbons.

DETAILED DESCRIPTION

In FIGS. 1-5, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

FIGS. 1-5 provide illustrative, non-exclusive examples of apparatus, systems and methods for removing fluids from a well, according to the present disclosure, together with elements that may include, be associated with, be operatively attached to, and/or utilize such apparatus, systems and methods.

Although the approach disclosed herein can be applied to a variety of subterranean well designs and operations, the present description will primarily be directed to systems for removing fluids from a well.

Figure 1:
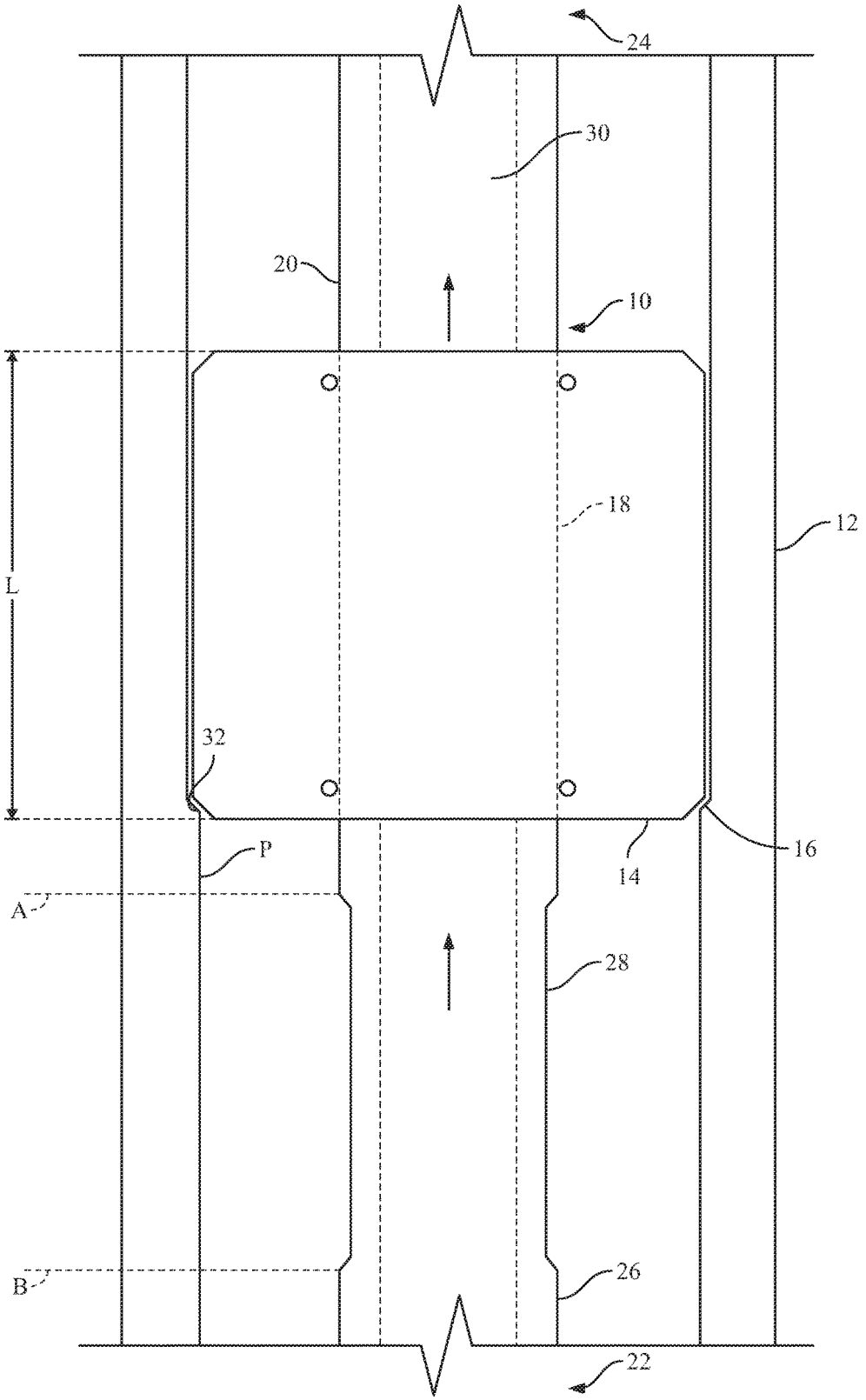
FIG. 1 presents a schematic view of an illustrative, nonexclusive example of an apparatus for reducing the force required to pull a device from a tubular, according to the present disclosure.

FIG. 1 presents, for illustrative purposes, a schematic view of an apparatus 10 for reducing the force required to pull a device from a tubular 12. The apparatus 10 includes a tubular sealing device 14 for mating with a downhole tubular component 16, the tubular sealing device 14 having an axial length L and a longitudinal bore 18 therethrough.

Apparatus 10 may serve to reduce the force required to pull a broad range of devices from a tubular. Such devices may include, but are not limited to, a variety of downhole pumps, drivers, screens, filters, valves, instrumentation packages, or the like.

Apparatus 10 also includes an elongated rod 20, slidably positionable within the longitudinal bore 18 of the tubular sealing device 14. The elongated rod 20 includes a first end 22, a second end 24, and an outer surface 26. As shown in FIG. 1, the outer surface 26 of elongated rod 20 is structured and arranged to provide a hydraulic seal when the elongated rod is in a first position (when position A is aligned with point P) within the longitudinal bore 18 of the tubular sealing device 14. Also, as shown in FIG. 1, the outer surface 26 of elongated rod 20 is structured and arranged to provide at least one external flow port 28 for pressure equalization upstream and downstream of the tubular sealing device 14 when the elongated rod 20 is placed in a second position (when position B is aligned with point P) within the longitudinal bore 18 of the tubular sealing device 14.

In some embodiments, the elongated rod 20 includes an axial flow passage 30 extending therethrough. As will be described below, with reference to FIGS. 2 and 3, in some embodiments, the elongated rod 20 is structured and arranged for placing it in fluid communication with a pump upstream or downstream of the tubular sealing device 14.

In some embodiments, the tubular sealing device 14 is structured and arranged for landing within a nipple profile (not shown) or for attaching to a collar stop 32 for landing directly within the tubular 12.

As will be described below, with reference to FIGS. 2 and 3, in some embodiments, the apparatus 10 is structured and arranged to be installed and retrieved from the tubular 12 by a wireline or a coiled tubing. In some embodiments, apparatus 10 is integral to the tubular 12.

As will be described below, with reference to FIGS. 2 and 3, in some embodiments, the first end of the elongated rod includes an extension for applying a jarring force to the tubular sealing device 14 to assist in the removal thereof.

Figure 2:
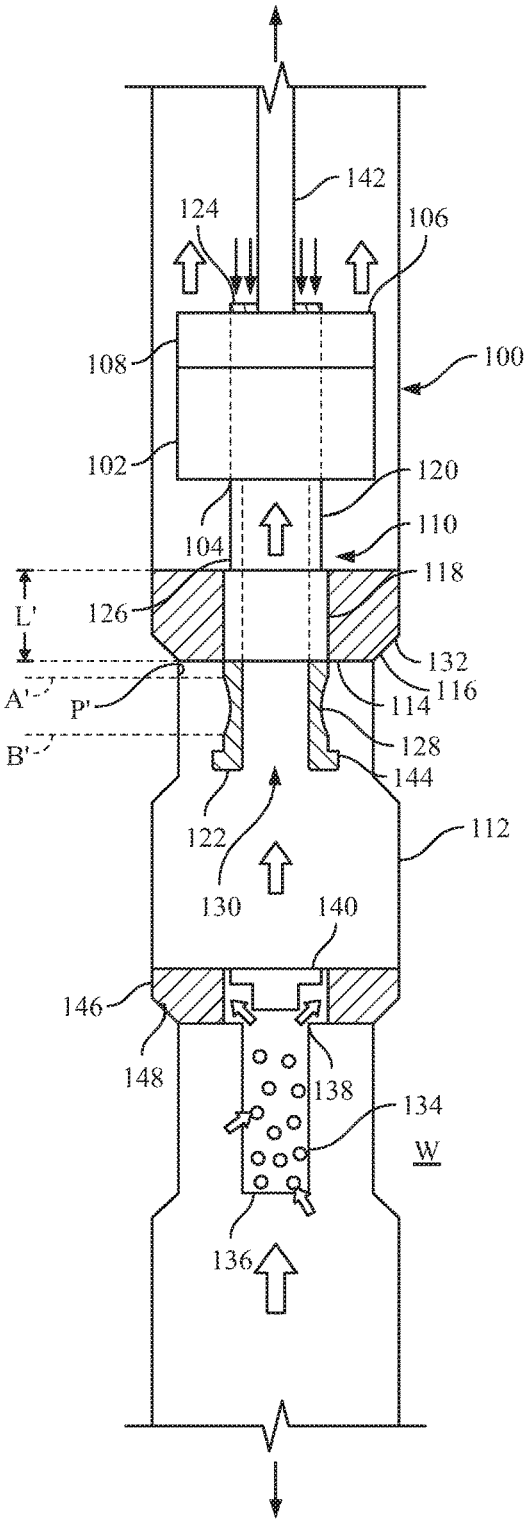
FIG. 2 presents a schematic view of an illustrative, nonexclusive example of a system for removing fluids from a well, according to the present disclosure.

Referring now to FIG. 2, a schematic view of an illustrative, nonexclusive example of a system for 100 removing fluids from a well, according to the present disclosure is presented. The system 100 includes a pump 102 having an inlet end 104 and a discharge end 106. A driver 108 is operatively connected to the pump 102 for driving the pump 102.

The system 100 also includes an apparatus 110 for reducing the force required to pull the pump 102 from a tubular 112. As shown, the apparatus 110 may be positioned upstream of the pump 102. Apparatus 110 includes a tubular sealing device 114 for mating with a downhole tubular component 116, the tubular sealing device 114 having an axial length L' and a longitudinal bore 118 therethrough.

Apparatus 110 also includes an elongated rod 120, slidably positionable within the longitudinal bore 118 of the tubular sealing device 114. The elongated rod 120 includes a first end 122, a second end 124, and an outer surface 126. As shown in FIG. 2, the outer surface 126 is structured and arranged to provide a hydraulic seal when the elongated rod is in a first position (when position A' is aligned with point P') within the longitudinal bore 118 of the tubular sealing device 114. Also, as shown in FIG. 2, the outer surface 126 of elongated rod 120 is structured and arranged to provide at least one external flow port 128 for pressure equalization upstream and downstream of the tubular sealing device 114 when the elongated rod 120 is placed in a second position (when position B' is aligned with point P') within the longitudinal bore 118 of the tubular sealing device 114.

In some embodiments, the elongated rod 120 includes an axial flow passage 130 extending therethrough, the axial flow passage in fluid communication with the pump 102.

In some embodiments, the tubular sealing device 114 is structured and arranged for landing within a nipple profile (not shown) or for attaching to a collar stop 132 for landing directly within the tubular 112.

In some embodiments, a well screen or filter 134 is provided, the well screen or filter 134 in fluid communication with the inlet end 104 of the pump 102, the well screen or filter 134 having an inlet end 136 and an outlet end 138.

In some embodiments, a velocity fuse or standing valve 140 is positioned between the outlet end 138 of the well screen or filter 134 and the first end 122 of the elongated rod 120. As shown, the velocity fuse 140 is in fluid communication with the well screen or filter 134.

In some embodiments, the velocity fuse 140 is structured and arranged to back-flush the well screen or filter 134 and maintain a column of fluid within the tubular 112 in response to an increase in pressure drop across the velocity fuse 140. As will be described below, with reference to FIG. 4. in some embodiments, the velocity fuse 140 is normally open and comprises a spring-loaded piston responsive to changes in pressure drop across the velocity fuse 140.

In some embodiments, the apparatus 110 is structured and arranged to be installed and retrieved from the tubular 112 by a wireline or a coiled tubing 142. In some embodiments, the apparatus 110 is integral to the tubing string.

In some embodiments, the first end 122 of the elongated rod 120 includes an extension 144 for applying a jarring force to the tubular sealing device 114 to assist in the removal thereof.

In some embodiments, the velocity fuse 140 may be installed within a housing 146. In some embodiments, the housing 146 is structured and arranged for sealingly engaging the tubular 112. In some embodiments, the housing 146 comprises at least one seal 148. In some embodiments, the housing 146 may be configured to seat within a tubular 112, as shown.

Figure 3:
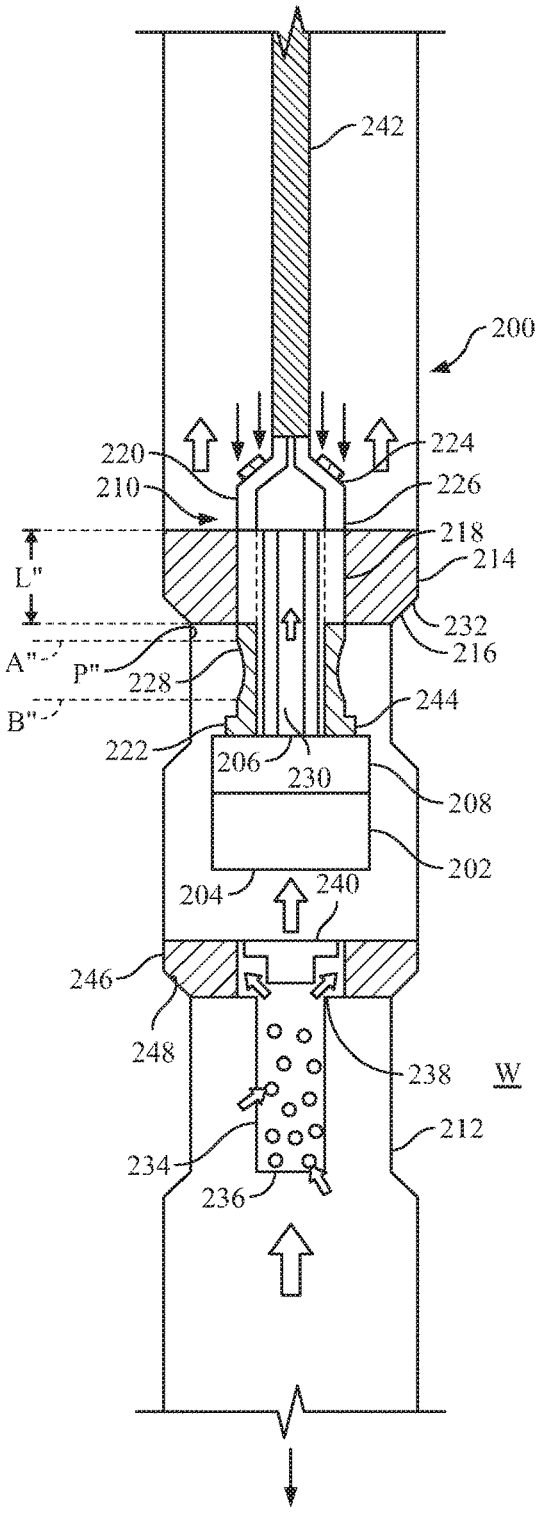
FIG. 3 presents a schematic view of another illustrative, nonexclusive example of a system for removing fluids from a well, according to the present disclosure.

Referring now to FIG. 3, a schematic view of an illustrative, nonexclusive example of a system for 200 removing fluids from a well, according to the present disclosure is presented. The system 200 includes a pump 202 having an inlet end 204 and a discharge end 206. A driver 208 is operatively connected to the pump 202 for driving the pump 202.

The system 200 also includes an apparatus 210 for reducing the force required to pull the pump 202 from a tubular 212. As shown, the apparatus 210 may be positioned downstream of the pump 202. Apparatus 210 includes a tubular sealing device 214 for mating with a downhole tubular component 216, the tubular sealing device 214 having an axial length L" and an longitudinal bore 218 therethrough.

Apparatus 210 also includes an elongated rod 220, slidably positionable within the longitudinal bore 218 of the tubular sealing device 214. The elongated rod 220 includes a first end 222, a second end 224, and an outer surface 226. As shown in FIG. 3, the outer surface 226 is structured and arranged to provide a hydraulic seal when the elongated rod is in a first position (when position A" is aligned with point P") within the longitudinal bore 218 of the tubular sealing device 214. Also, as shown in FIG. 3, the outer surface 226 of elongated rod 220 is structured and arranged to provide at least one external flow port 228 for pressure equalization upstream and downstream of the tubular sealing device 214 when the elongated rod 220 is placed in a second position (when position B" is aligned with point P") within the longitudinal bore 218 of the tubular sealing device 214.

In some embodiments, the elongated rod 220 includes an axial flow passage 230 extending therethrough, the axial flow passage in fluid communication with the pump 202.

In some embodiments, the tubular sealing device 214 is structured and arranged for landing within a nipple profile (not shown) or for attaching to a collar stop 232 for landing directly within the tubular 212.

In some embodiments, a well screen or filter 234 is provided, the well screen or filter 234 in fluid communication with the inlet end 204 of the pump 202, the well screen or filter 234 having an inlet end 236 and an outlet end 238.

In some embodiments, a velocity fuse or standing valve 240 is positioned between the outlet end 238 of the well screen or filter 234 and the first end 222 of the elongated rod 220. As shown, the velocity fuse 240 is in fluid communication with the well screen or filter 234.

In some embodiments, the velocity fuse 240 is structured and arranged to back-flush the well screen or filter 232 and maintain a column of fluid within the tubular 212 in response to an increase in pressure drop across the velocity fuse 240. As will be described below, with reference to FIG. 4. in some embodiments, the velocity fuse 240 is normally open and comprises a spring-loaded piston responsive to changes in pressure drop across the velocity fuse 240.

In some embodiments, the apparatus 210 is structured and arranged to be installed and retrieved from the tubular 212 by a wireline or a coiled tubing 242. In some embodiments, the apparatus 210 is integral to the tubing string.

In some embodiments, the first end 222 of the elongated rod 220 includes an extension 244 for applying a jarring force to the tubular sealing device 214 to assist in the removal thereof.

In some embodiments, the velocity fuse 240 may be installed within a housing 246. In some embodiments, the housing 246 is structured and arranged for sealingly engaging the tubular 212. In some embodiments, the housing 246 comprises at least one seal 248. In some embodiments, the housing 246 may be configured to seat within a tubular 212, as shown.

Figure 4:
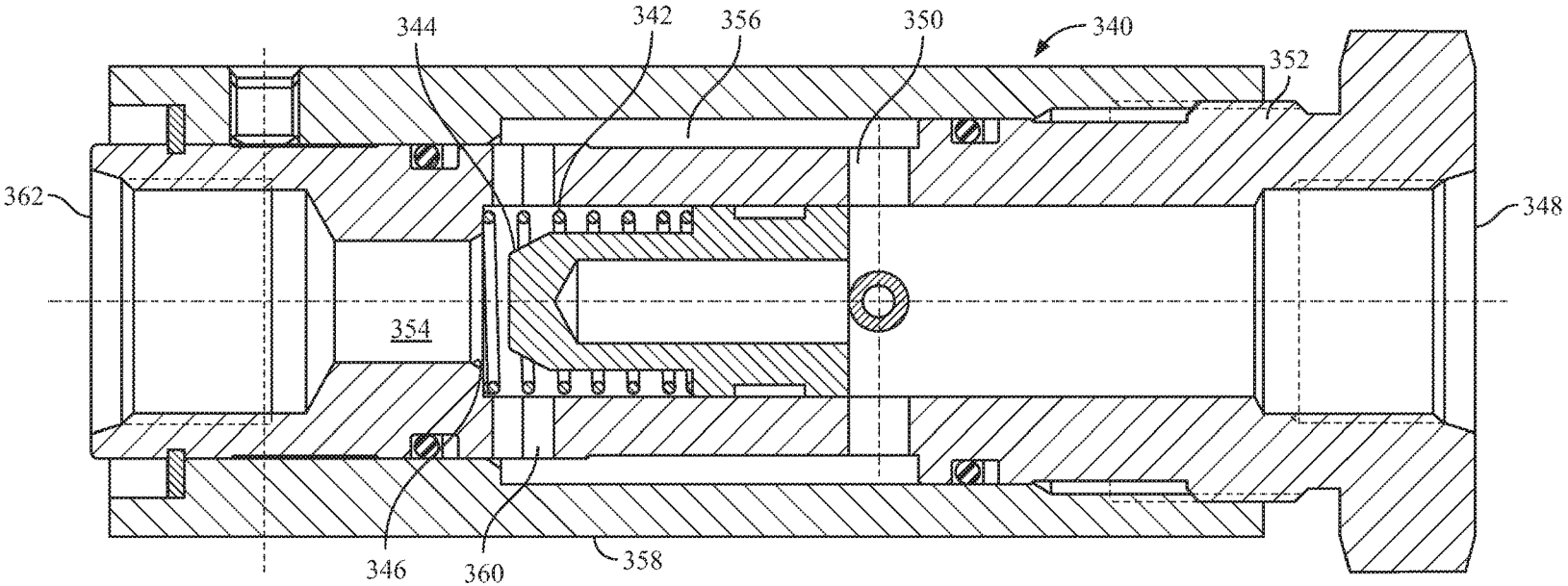
FIG. 4 presents a cross-sectional view of an illustrative, nonexclusive example of a velocity fuse having utility in the apparatus, systems and methods of the present disclosure.
Figure 5:
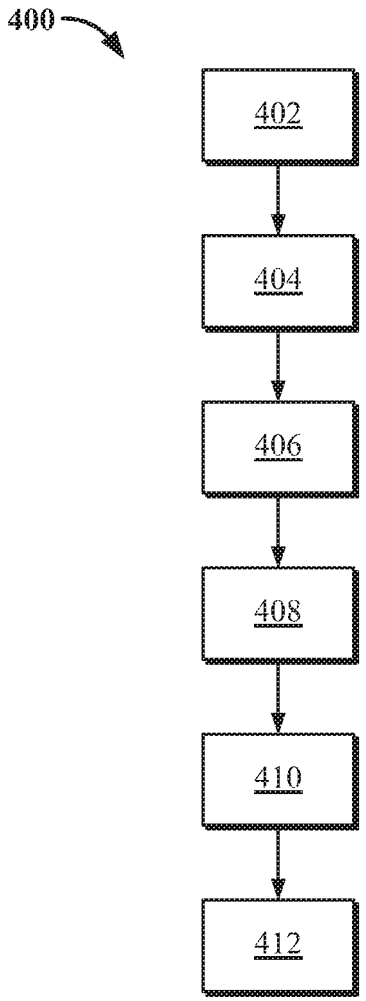
FIG. 5 presents a flow chart of an illustrative, nonexclusive example of a method for reducing the force required to pull a device from a tubular, according to the present disclosure.

Referring now to FIG. 4, a cross-sectional view of an illustrative, nonexclusive example of a velocity fuse 340 having utility in the systems 100 and 200 of the present disclosure. In some embodiments, the velocity fuse 340 is an adjustable velocity fuse, which may be configured to be a normally open, in-line valve. Under normal operating conditions, a spring 342 holds the velocity fuse poppet 344 off a poppet seat 346.

Flow enters the velocity fuse 340 at a flanged inlet port 348. Before reaching the velocity fuse poppet 344, a series of radial holes 350 in body or piston 352 directs flow from body core 354 into an annular cavity 356 between the body 352 and an adjusting sleeve 358. Flow is directed axially between the body 352 and adjusting sleeve 358 until it reaches another series of radial holes 360 at the poppet seat 346. Flow is then directed back into the body core 354 through the poppet seat 346 and out the fuse outlet port 362.

In some embodiments, external adjustments of the adjusting sleeve 358 may be made to reduce the free area of the radial holes 360. This reduction in area creates an increase in flow velocity, resulting in a higher pressure drop. When the pressure drop exceeds the spring force K holding the velocity fuse poppet 344 open, the inlet pressure will force the velocity fuse poppet 344 against the poppet seat 346, effectively closing the velocity fuse 340.

The velocity fuse 340 can be adjusted such that, at normal flows, the velocity fuse 340 will remain open but increased flow rates, such as caused by downstream line rupture, will result in a rapid closing of the velocity fuse 340. The velocity fuse 340 will remain closed until the inlet pressure is eliminated or the downstream pressure is equalized with the inlet.

In some embodiments, the velocity fuse 340 is normally open and comprises a spring-loaded velocity fuse poppet 344 responsive to changes in pressure drop across the velocity fuse 340. In some embodiments, the velocity fuse 340 may be adjusted to a predetermined flow velocity set-point for closure.

Suitable velocity fuses are commercially available from a variety of sources, including the Hydraulic Valve Division of Parker Hannifin Corporation, Elyria, Ohio, USA, and Vonberg Valve, Inc., Rolling Meadows, Ill., USA. In particular, two sizes of commercially available velocity fuses are expected to have utility in the practice of the present disclosure. These are: a velocity fuse having a 1" OD, with a flow range of 11 liters/minute (3 GPM) to 102 liters/minute (27 GPM), and a velocity of having a 1.5" OD, with a flow range of: 23 liters/minute (6 GPM) to 227 liters/minute (60 GPM). Each of these commercially available velocity sleeves have a maximum working pressure of 5,000 psi and a temperature ratings of −20 F to +350 F (−27C to +177C). The body and sleeve are made of brass, and the poppet, roll pin, and spring are made of stainless steel. O-rings are both nitrile and PTFE. Custom-built velocity fuses are envisioned and may provide a higher pressure rated device, if needed, which may be incorporated into a housing for seating in the no-go profile nipple.

In operation, during an initial surge of fluid from unseating the pump using the wireline, several barrels of fluid at high rate will reverse flow across the screen or filter, dislodging debris. This instantaneous fluid pulse would cause the velocity fuse to close. The wireline operator could then reseat the pump within the profile nipple having only lifted it a few feet in the well. Shutting in the well for a few hours after reseating the pump would allow loose solids from the backflush operation to settle into the bottom of the well. This serves to prevent those solids from ever contacting the screen again, as well as prevent their over-displacement into the formation via perforation tunnels or the like.

Referring to FIG. 4, in another aspect, provided is a method for reducing the force required to pull a device from a tubular 400. The method 400 includes the steps of 402, connecting an apparatus positioned within a tubular to a retrieval mechanism, the apparatus including a tubular sealing device having an axial length and a longitudinal bore therethrough; and an elongated rod slidably positionable within the longitudinal bore of the tubular sealing device, the elongated rod structured and arranged to provide i) a hydraulic seal when the elongated rod is in a first position within the longitudinal bore, and ii) at least one external flow port for pressure equalization upstream and downstream of the tubular sealing device when the elongated rod is placed in a second position within the longitudinal bore; 404, applying a force to the elongated rod of the apparatus; 406, pulling the elongated rod through the tubular sealing device; and 408, equalizing the pressure upstream and downstream of the tubular sealing device.

In some embodiments, the method includes 410, applying a jarring force to the upstream side of the tubing sealing assembly to assist in the removal thereof.

In some embodiments, the method includes 412, back-flushing an upstream well screen or filter installed within the tubular. In some embodiments, the step of back-flushing an upstream well screen or filter includes providing a differential pressure across a velocity fuse, the velocity fuse positioned downstream of the well screen or filter, to create a high-velocity stream of fluid to back-flush the upstream well screen or filter; removing debris from the upstream well screen or filter; closing the velocity fuse using the high-velocity fluid stream; and setting the elongated rod to the first position to establish the hydraulic seal.

In some embodiments, the velocity fuse is structured and arranged to maintain a column of fluid within the tubular in response to an increase in pressure drop across the velocity fuse. In some embodiments, the velocity fuse comprises a spring-loaded piston responsive to changes in pressure drop across the velocity fuse.

In some embodiments, the elongated rod includes an axial flow passage extending therethrough.

In some embodiments, the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing. In some embodiments, the apparatus is integral to the tubing string.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

Illustrative, non-exclusive examples of assemblies, systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus, systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An apparatus for reducing the force required to pull a device from a tubular, comprising:

a) a tubular sealing device for mating with a downhole tubular component, the tubular sealing device having an axial length and a longitudinal bore therethrough; and b) an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device;

c) a well screen or filter in fluid communication with the inlet end of the pump, the well screen or filter having an inlet end and an outlet end; and d) a velocity fuse or standing valve positioned between the outlet end of the well screen or filter and the first end of the elongated rod.

2. The apparatus of claim 1, wherein the elongated rod includes an axial flow passage extending therethrough.

3. The apparatus of claim 1, wherein the tubular sealing device is structured and arranged for landing within a nipple profile or for attaching to a collar stop for landing directly within the tubular.

4. The apparatus of claim 1, wherein the apparatus is structured and arranged to be installed and retrieved from the tubular by a wireline or a coiled tubing.

5. The apparatus of claim 1, wherein the apparatus is integral to the tubing string.

6. The apparatus of claim 1, wherein the first end of the elongated rod includes an extension for applying a jarring force to the tubular sealing device to assist in the removal thereof.

7. The apparatus of claim 1, wherein the elongated rod is structured and arranged for placing it in fluid communication with a pump upstream or downstream of the tubular sealing device.

8. A system for removing fluids from a well, the system comprising:

a) a pump having an inlet end and a discharge end, the pump placed within a tubular;

b) a driver operatively connected to the pump for driving the pump;

c) an apparatus for reducing the force required to pull the pump from the tubular, the apparatus positioned upstream of the pump and comprising a tubular sealing device for mating with a downhole tubular component, the tubular sealing device having an axial length and a longitudinal bore therethrough; and an elongated rod slidably positionable within the longitudinal bore of the tubular sealing device, the elongated rod having a first end, a second end, and an outer surface, the outer surface structured and arranged to provide i) a hydraulic seal when the elongated rod is in a first position within the longitudinal bore of the tubular sealing device, and ii) at least one external flow port for pressure equalization upstream and downstream of the tubular sealing device when the elongated rod is placed in a second position within the longitudinal bore of the tubular sealing device;

d) a well screen or filter in fluid communication with the inlet end of the pump, the well screen or filter having an inlet end and an outlet end; and e) a velocity fuse or standing valve positioned between the outlet end of the well screen or filter and the first end of the elongated rod;

wherein the elongated rod includes an axial flow passage extending therethrough, the axial flow passage in fluid communication with the pump.

9. The system of claim 8, wherein the velocity fuse is structured and arranged to back-flush the well screen or filter and maintain a column of fluid within the tubular in response to an increase in pressure drop across the velocity fuse.

10. The system of claim 9, wherein the velocity fuse is biased in an open position and comprises a spring-loaded piston responsive to changes in pressure drop across the velocity fuse.

11. The system of claim 8, wherein the tubular sealing device of the apparatus is structured and arranged for landing within a nipple profile or for attaching to a collar stop for landing directly within the tubular.

12. The system of claim 8, wherein the apparatus is structured and arranged to be installed and retrieved from the tubular by a wireline or a coiled tubing.

13. The system of claim 8, wherein the apparatus is integral to the tubing string.

14. The system of claim 8, wherein the first end of the elongated rod includes an extension for applying a jarring force to the tubular sealing device to assist in the removal thereof.

15. A method for reducing the force required to pull a device from a tubular, comprising:

a) connecting an apparatus positioned within a tubular to a retrieval mechanism, the apparatus including a tubular sealing device having an axial length and a longitudinal bore therethrough; and an elongated rod slidably positionable within the longitudinal bore of the tubular sealing device, the elongated rod structured and arranged to provide i) a hydraulic seal when the elongated rod is in a first position within the longitudinal bore, and ii) at least one external flow port for pressure equalization upstream and downstream of the tubular sealing device when the elongated rod is placed in a second position within the longitudinal bore;

b) applying a force to the elongated rod of the apparatus and applying a jarring force to the upstream side of the tubing sealing assembly to assist in the removal thereof;

c) pulling the elongated rod through the tubular sealing device; and d) equalizing the pressure upstream and downstream of the tubular sealing device.

16. The method of claim 15, further comprising back-flushing an upstream well screen or filter installed within the tubular.

17. The method of claim 16, wherein the step of back-flushing an upstream well screen or filter comprises:

providing a differential pressure across a velocity fuse, the velocity fuse positioned downstream of the well screen or filter, to create a high-velocity stream of fluid to back-flush the upstream well screen or filter;

removing debris from the upstream well screen or filter;

closing the velocity fuse using the high-velocity fluid stream; and setting the elongated rod to the first position to establish the hydraulic seal.

18. The method of claim 17, wherein the velocity fuse is structured and arranged to maintain a column of fluid within the tubular in response to an increase in pressure drop across the velocity fuse.

19. The method of claim 18, wherein the velocity fuse comprises a spring-loaded piston responsive to changes in pressure drop across the velocity fuse.

20. The method of claim 15, wherein the elongated rod includes an axial flow passage extending therethrough.

21. The method of claim 15, wherein the tubular sealing device is structured and arranged for landing within a nipple profile or for attaching to a collar stop for landing directly within the tubular.

22. The method of claim 15, wherein the apparatus is structured and arranged to be installed and retrieved from the tubular by a wireline or a coiled tubing.

23. The method of claim 15, wherein the apparatus is integral to the tubing string.

24. A method of producing hydrocarbons from a subterranean formation, the method comprising:

providing a borehole extending into a hydrocarbon-bearing zone of the formation;

installing a tubular into the borehole;

installing an apparatus for reducing the force required to pull a device from the tubular, the apparatus comprising i) a tubular sealing device for mating with a downhole tubular component, the tubular sealing device having an axial length and a longitudinal bore therethrough; and ii) an elongated rod slidably positionable within the longitudinal bore of the tubular sealing device, the elongated rod having a first end, a second end, and an outer surface, the outer surface structured and arranged to provide 1) a hydraulic seal when the elongated rod is in a first position within the longitudinal bore of the tubular sealing device, and 2) at least one external flow port for pressure equalization upstream and downstream of the tubular sealing device when the elongated rod is placed in a second position within the longitudinal bore of the tubular sealing device;

applying a jarring force to the upstream side of the tubing sealing assembly to assist in the removal thereof;

providing a differential pressure across a velocity fuse, the velocity fuse positioned downstream of the well screen or filter, to create a high-velocity stream of fluid to back-flush the upstream well screen or filter;

removing debris from the upstream well screen or filter;

closing the velocity fuse using the high-velocity fluid stream; and setting the elongated rod to the first position to establish the hydraulic seal; and producing a fluid comprising hydrocarbons.

25. The method of claim 24, wherein the velocity fuse is structured and arranged to maintain a column of fluid within the tubular in response to an increase in pressure drop across the velocity fuse.

* * * * *